US007690125B2

(12) United States Patent
Lenz

(10) Patent No.: US 7,690,125 B2
(45) Date of Patent: Apr. 6, 2010

(54) CONSTRUCTION LAYOUT TOOL

(76) Inventor: Joseph Brian Lenz, 1439 Louisiana St., Vallejo, CA (US) 94590

( * ) Notice: Subject to any disclaimer, the term of this patent is extended or adjusted under 35 U.S.C. 154(b) by 0 days.

(21) Appl. No.: 12/231,108

(22) Filed: Aug. 29, 2008

(65) Prior Publication Data

US 2010/0050450 A1 Mar. 4, 2010

(51) Int. Cl.
*B44D 3/38* (2006.01)

(52) U.S. Cl. ..... 33/414; 33/413; 33/1 LE

(58) Field of Classification Search ..... 33/404–410, 33/413, 414, 1 G, 1 LE
See application file for complete search history.

(56) References Cited

U.S. PATENT DOCUMENTS 299,625 A * 6/1884 Covell ..... 33/413
3,145,477 A * 8/1964 Morrison ..... 33/770
3,662,471 A * 5/1972 Lynde ..... 33/770
4,566,198 A * 1/1986 Vitale ..... 33/759
4,921,507 A * 5/1990 Beyer ..... 33/413
5,022,158 A * 6/1991 Beyer ..... 33/413
6,360,445 B1 * 3/2002 Haas ..... 33/16
6,578,274 B1 * 6/2003 Tango et al. ..... 33/1 G
6,842,992 B1 * 1/2005 Gitt ..... 33/404
7,269,907 B2 * 9/2007 Levine et al. ..... 33/286

* cited by examiner

*Primary Examiner*—Yaritza Guadalupe-McCall
(74) *Attorney, Agent, or Firm*—Gerald L. Robertson

(57) ABSTRACT

A construction layout device comprising a body having a front face, rear face and two side faces; at least one base plate fastened to the underside of said body and providing support therefor atop a worksurface; a handle fastened atop said body, said handle having one termination proximate to said front face and a second termination proximate to said rear face; a first protrusion fastened to either said front face or one of said side faces, said protrusion having a through bore, said through bore normal to said worksurface; and at least one adjustable pin inserted in said through bore for holding a chalk line or other layout means.

5 Claims, 5 Drawing Sheets

CONSTRUCTION LAYOUT TOOL

STATEMENT OF GOVERNMENTAL ASSISTANCE

Applicant hereby represents that no part of the subject invention or application has come about with the assistance of government funds or by virtue of a government program.

FIELD OF THE INVENTION

The present invention relates generally to layout devices or tools commonly used to provide straight line runs, accurate angles and stability to alignment means such as lasers, chalk lines, wires and other media suitable for establishing floor, wall and associated orientation for the construction of residential, industrial and commercial objects of construction including but not limited to floors, walls, plumbing and electrical layouts, parking lot lines, street medians, markings and others.

BACKGROUND OF THE INVENTION

Presently, in the field of layout tools, many solutions have been offered, in many cases including multiple means of scribing or indicating lines, means for attaching chalk lines or wires, leveling means, laser emitters and fixtures for attaching same, indexes for measuring small distances, holders for tape measures and more.

U.S. Pat. No. 5,022,158 for a WALL MARKING LAYOUT DEVICE issued to Beyer on Jun. 11, 1991, disclosing a layout device with an elongated rectangular body. The Beyer patent disclosed a device fashioned from dense material and was provided with vertical alignment pins to enable vertical adjustments. Further, grooves were provided to allow the use of chalk lines during the layout procedure.

Beyer, while providing a device of substantial weight for use in performing layout procedures, is somewhat simple, providing the predominant function necessary for solo use, but carries with it some limitations as will be more fully discussed below.

U.S. Pat. No. 6,578,274 B1 for a CONSTRUCTION LAYOUT BLOCK issued to Tango, Jr. et al. on Jun. 17, 2003, also shares the commonality of substantial weight and a handle, but as well tries to include so many features for alignment that it actually limits its usage in the industrial or commercial setting as being too precise for the typically rugged duty experienced by such tools.

Beyer and Tango, Jr. et al. may be considered the two "ends of the spectrum" from the simple to the complex as far as layout tools are concerned.

In the case of Breyer, the unit appears to be quite rugged and simple. The basic function of a weighty tool which may stay in place is present. The propensity to stay in place during use is somewhat compromised, however by the provision of elevation pins. With the pins extended, the amount of surface area in contact with the work surface underneath becomes inherently limited in the amount of adhesion which can be transmitted to the work surface, thereby affecting the amount of pull which might cause the unit to move, thereby limiting the length of line which may be employed and the distance traversed.

What is needed then is a device which may provide vertical indexing but which also may be stable for use with string or wire pulls of substantial tension, the device being resistant to movement during operation, such as long lines in commercial environments, including large diameter lines such as those used for parking lot layouts, street median lines, striping and the like.

Further, with the body in such an elongated shape as disclosed by Breyer, constant use of the device causes a great deal of torque to be experience by the user's hand and wrist, putting undue stress on the wrist, which may become fatigued over time and subject to injury or sprain if lifted too abruptly or without smooth, deliberate movement.

What is needed is a device which has substantial weight or other provision to prevent slippage, but which also is more ergonomically friendly for the user.

On the other hand, Tonga, Jr. discloses a layout tool which has some weight, but which also has some precise features such as a laser alignment target notch and an intrinsic level. These are provisions which are not without some precision which means that the device must be cared for with a relative amount of safety to assure that the device does not require constant calibration. When a level bulb is provided on a device, the device must be guarded from impact and jarring to keep the level bulb in correct position relative to the device. Further, an alignment notch for a laser must be kept safe from debris buildup, galling, dents, etc. When precision features are included in a layout tool, the tool must then be cared for either in its own case or separate from other tools which may by their interaction; e.g., being tossed into a gangbox or truck bed, damage each other.

What is needed is a layout tool which accomplishes the major layout tasks commonly used, and which may also be stored and transported in a tool or gang box, essentially impervious to being bumped by or underneath other heavy industrial tools.

SUMMARY OF THE INVENTION

It is an object of the present invention to provide a rugged but useful layout device which is substantially ergonomic and easy to use, resistant to movement during operation, impervious to common, heavy duty industrial usage, and sufficiently precise for the intended job.

Applicant's device is compact compared to the device of Breyer. The preferred embodiment is typically fabricated from 1" thick mild steel or iron plate, with typically two base pads having at least one rubber pad fastened thereto, providing substantial friction with the work surface underneath, and resistant to movement during use.

Typically, a plurality of protrusions are, or at a minimum, one is supplied at typically right angles to one another where downwardly oriented pointers are adjustably secured for attached snap lines or wires in order to locate anticipated structures or lines. The pointers are replaceable over time if damaged, and are useful to assist in a degree of vertical alignment without the limitation of affecting pull resistance as in the Breyer device. The pointer may be oriented in a downward or upward direction.

Easy fabrication by welding makes production of the device economical. The only surfaces which might be desired to be accurately indexed relative to one another are the lower surface of the base pads, and the bores in the aforementioned protrusions which will house the adjustable pointers.

The stout nature of the device lends itself to heavy usage, and its nature of manufacture and the rugged pointers and protrusions are resistant to damage from being tossed into the bed of a truck or into a gangbox wherein other tools will be stored and transported.

Applicant's preferred embodiment also utilizes a handle which is oriented in such a way that it is easily manipulated by the user, allowing a natural twist to occur during the typical lift, thereby reducing the work done by the wrist in moving the device, an improvement over the prior art.

Applicant's device typically weighs approximately 30 to 40 pounds. However, by using the embodiment shown in FIGS. 4 and 5, even heavier tools may be employed to handle increased duty which includes higher snap line tension. By its weight the device avoids the necessity for pins, nails or other means to locate and fix the device in a desired position, particularly helpful in situations where the device may be used on concrete, tile or wood floors which should not be damaged.

As opposed to Breyer, applicant's tool utilizes rubber pads on the underside which not only protect the floor or work surface underneath, but also prevents slippage or damage when the tool is subjected to high snap line loading or tension.

Applicant's invention provides a clear solution to the needs as described above, yielding a rugged yet sufficiently precise layout device that is resistant to moving, ergonomically designed, non-damaging to sensitive surfaces and up to the task of withstanding heavy industrial use.

DETAILED DESCRIPTION OF THE INVENTION

Figure 1:
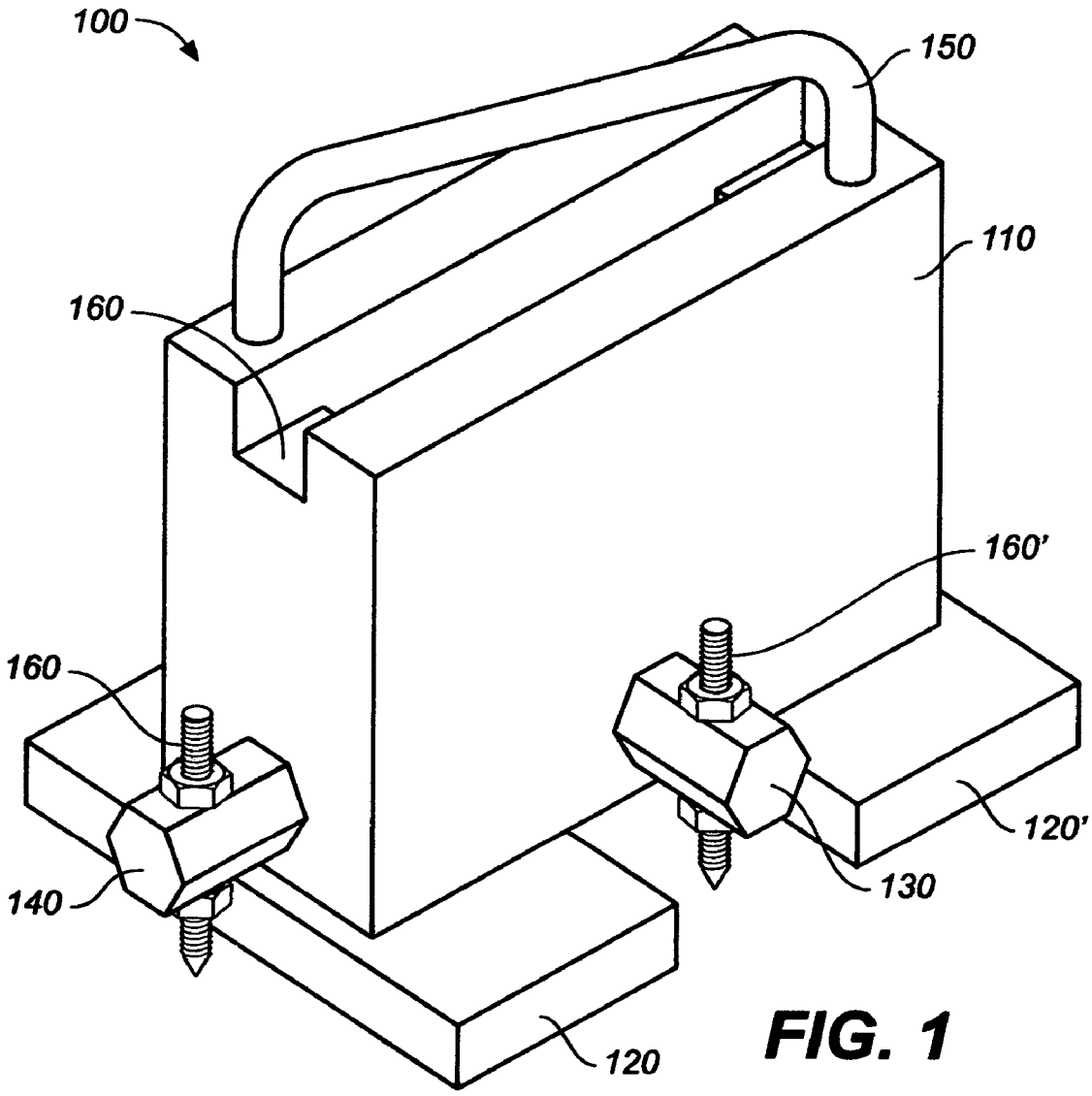
FIG. 1 is isometric view of the device showing both the front and side having protrusions fashioned thereon.

FIG. 1 shows device 100 having a body 110 supported by two base plates 120 and 120'. On the front of body 110 is fastened (typically by welding) a protrusion 130. A second protrusion 140 is fastened to the side of body 110. A handle 150 is fastened to the top of body 110. Bores (not shown in detail) in each protrusion and which may or may not be threaded, are provided to accept adjustable pins 160 and 160'. Rubber pads (not shown) are fastened to the bottom of plates 120 and 120'.

In the preferred embodiment, all parts of the device except adjustable pins 160 and 160' and said rubber pads (not shown) are fashioned from mild steel. A coat of paint is applied to prevent oxidation of the steel.

Figure 2:
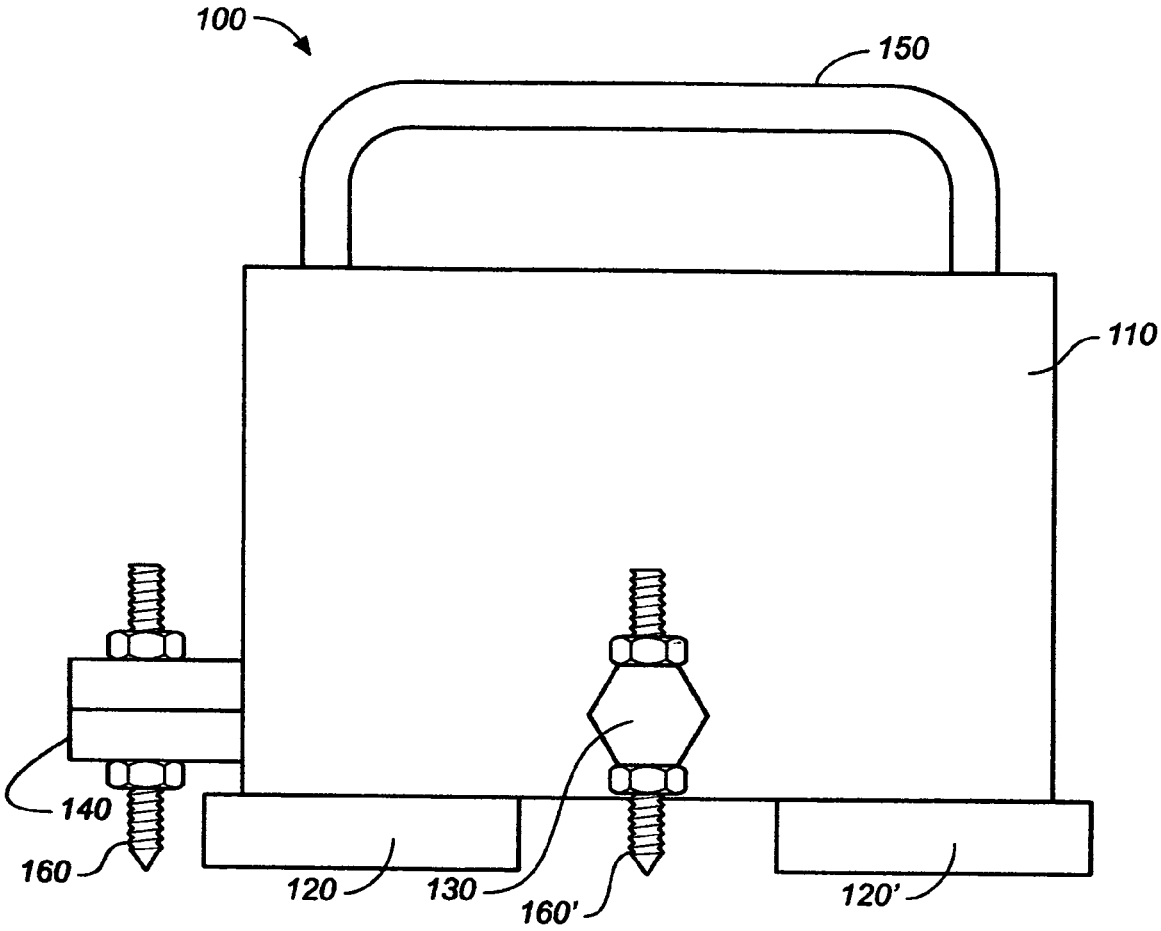
FIG. 2 is front view of the device in FIG. 1.

FIG. 2 shows the orientation of pads 120, 120', the angle of said protrusions being normal to one another, and metal spacers 170 and 170' joining two pieces of plate steel to form body 110. The weld beads constituting the fastening means for the various features of body 110 are evident in this figure.

Figure 3:
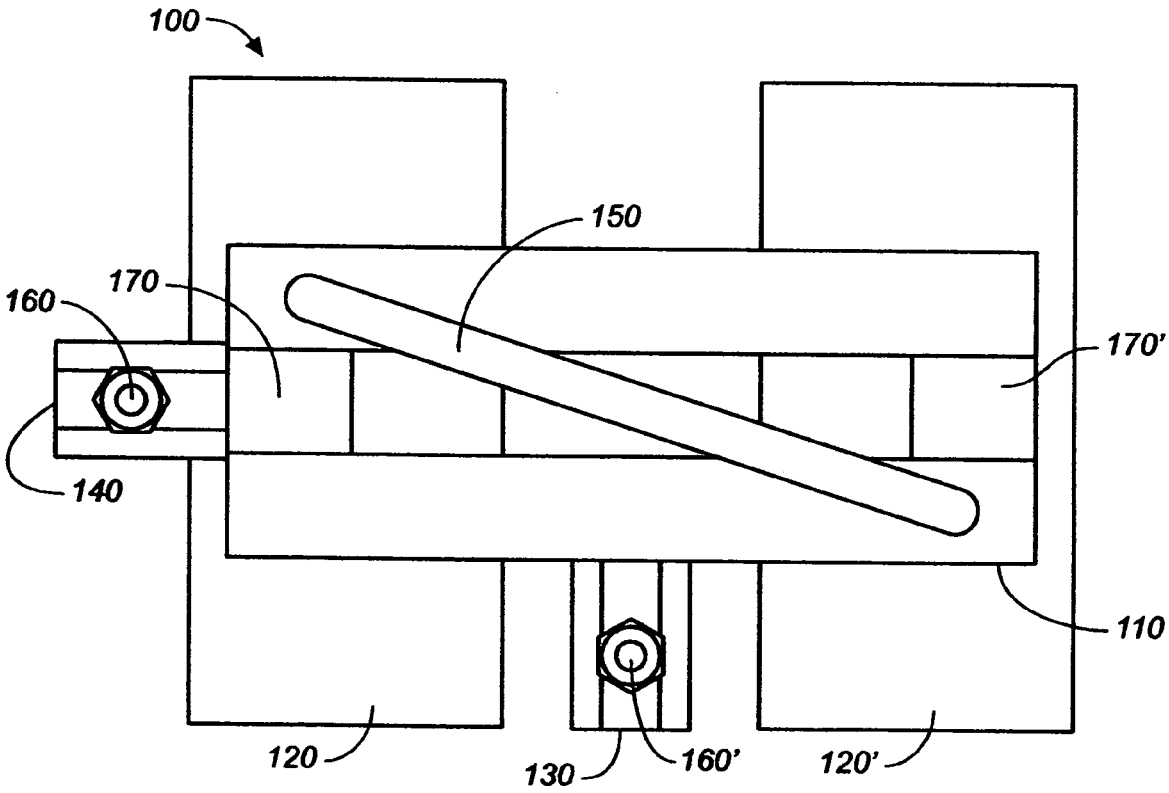
FIG. 3 is a top view of the device in FIG. 1.

FIG. 3 depicts the device from the rear of body 110, thereby showing the orientation of handle 150 on the top of the device. In this figure, protrusion 140 is clearly depicted, with adjustable pin 160 resident therein, and in engagement with a chalk line showing the use of said pin 160 in the downward directed orientation. Said pins 160 and 160' may be oriented in either the upward or downward directions. In the preferred embodiment, a radial groove may be provided proximate to the tip of said pin to engage a chalk line or other alignment line.

Figure 4:
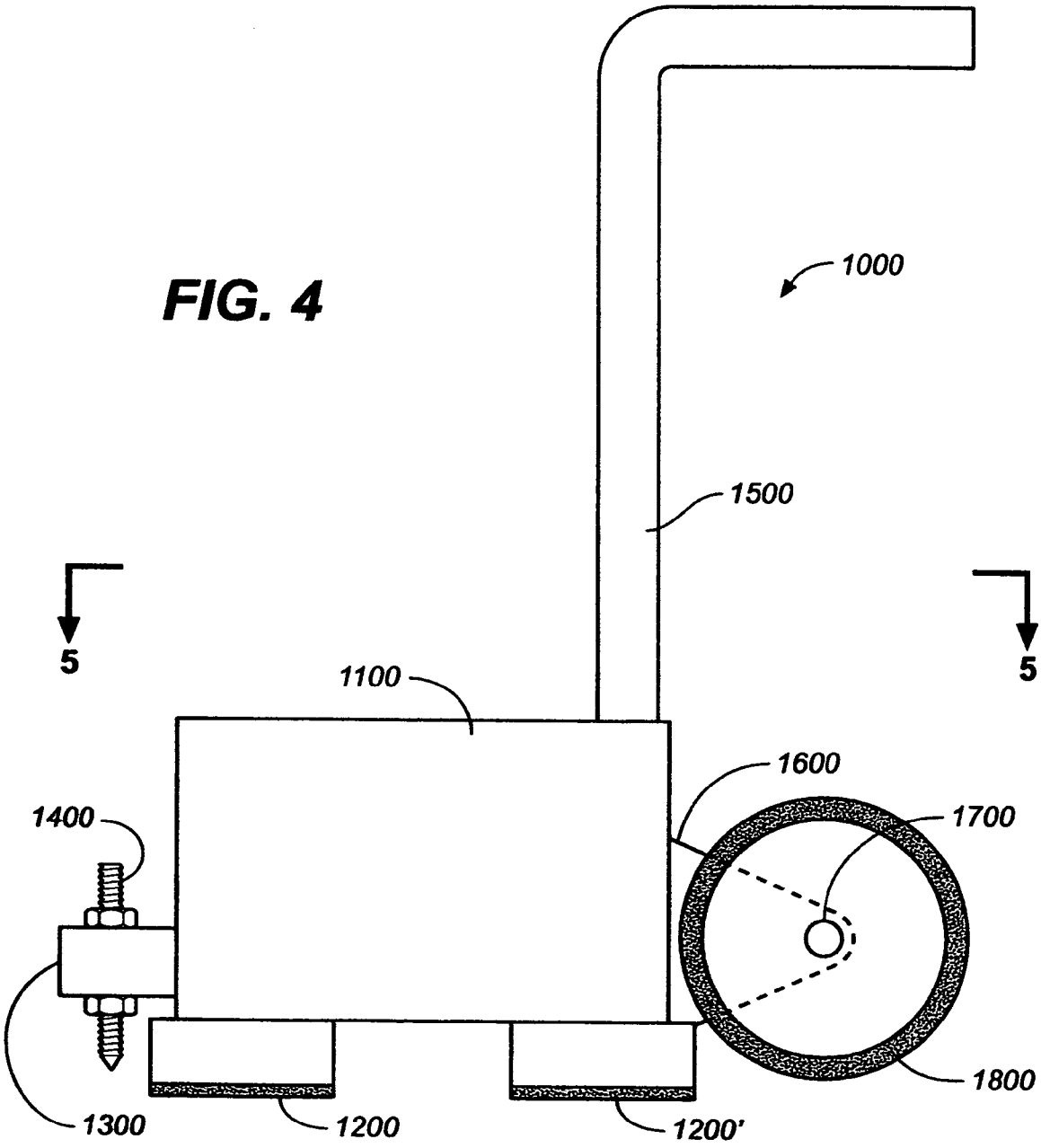
FIG. 4 is a side view of a second embodiment of applicant's invention featuring a set of wheels.

FIG. 4 shows a second embodiment of applicant's layout tool 1000. Said second embodiment has rubber pads 1200 and 1200', consistent with the first embodiment 100 depicted in FIGS. 1 through 3. Also consistent are protrusion 1300 with adjustable pin 1400, similarly fastened to body 1100. The second embodiment employs a differently configured handle 1500 which rises higher above body 1100 than in the first embodiment in FIGS. 1 through 3. A pair of brackets 1600 and 1600' (not shown) provide support for an axle 1700. Said brackets are typically welded to body 1100 in order to pivot said layout tool until a set of wheels, 1800 and 1800' (not shown) which are installed onto axle 1700 engage the work surface in order to facilitate the moving of said tool. This allows even heavier embodiments of the tool to be used depending on the application.

Figure 5:
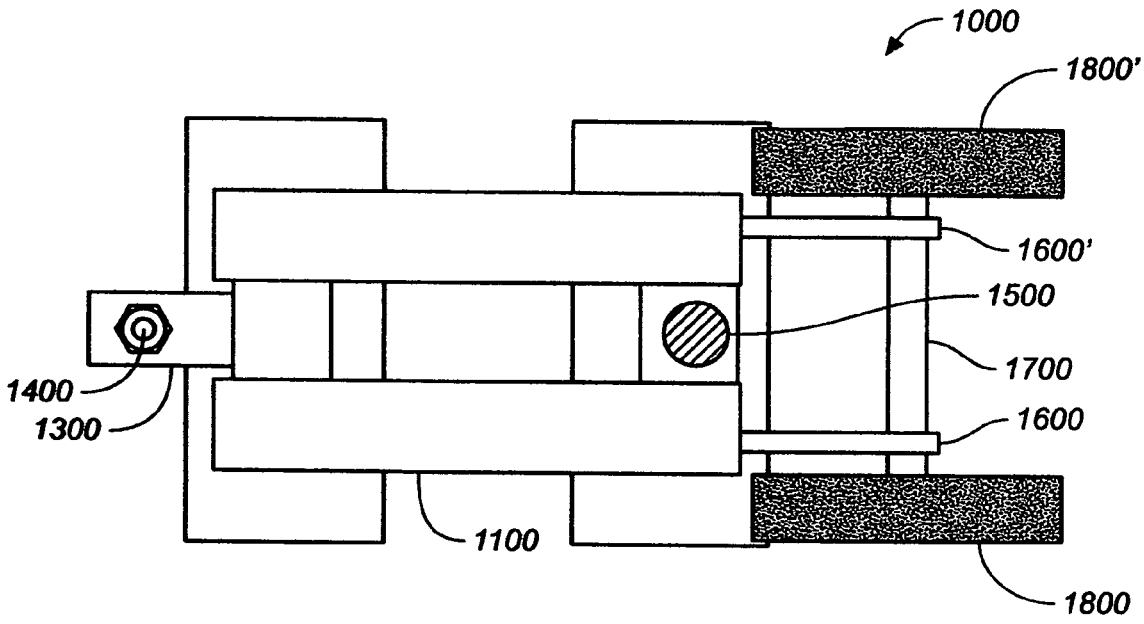
FIG. 5 is a top cross-sectional view taken through line 5-5 of the device as shown in FIG. 4.

FIG. 5 shows the orientation of brackets 1600, 1600', axle 1700 and wheels 1800 and 1800' in the embodiment first shown in FIG. 4. In this figure, only one protrusion and adjustable pin are shown, when a second protrusion and pin could also be attached to body 1100 just as shown in FIGS. 1 through 3.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

What is claimed is:

1. An improved construction layout tool comprising:

A body having a front face, rear face and two side faces;

At least one base plated fastened to the underside of said body and providing support therefore atop a worksurface:

A handle fastened atop said body, said handle having on termination proximate to said rear face;

At least one protrusion fastened to either said front face or one of said side faces, said protrusion having a through bore, said through bore normal to said worksurface;

An adjustable pin inserted in said through bore for holding a chalk line or other layout means;

A pair of brackets fastened to said rear of said body, said brackets having an axle therethrough, said axle retaining thereon a set of wheels positioned such that said tool may be tilted onto said wheels in order that said tool may be easily pivoted and moved.

2. The improved construction layout tool of claim 1 further comprising:

At least one rubber pad fastened to said base plate and in contact with said worksurface.

3. The improved construction layout tool of claim 2 further comprising:

A second protrusion fastened to a face of said body normal to said first protrusion, said second protrusion having a through bore, said through bore normal to said worksurface: and A second adjustable pin inserted in said through bore of said second protrusion for holding a chalk line or other layout means.

4. The improved construction layout tool of claim 3, further comprising:

Said through bores being threaded to engage adjustable pins also suitably threaded for engagement therewith.

5. The improved construction layout tool of claim 4 wherein:

said device having had applied a coat of paint.

* * * * *